US006089434A

United States Patent [19]

Gleason

[11] Patent Number: 6,089,434

[45] Date of Patent: Jul. 18, 2000

[54] AUTOMATIC FRAME MAKER

[75] Inventor: Michael E. Gleason, St. Albans, Vt.

[73] Assignee: Gleason Brothers Industries Inc., St. Albans, Vt.

[21] Appl. No.: 09/258,195

[22] Filed: Feb. 26, 1999

[51] Int. Cl.[7] ..... B27F 7/00; B27F 7/17

[52] U.S. Cl. ..... 227/3; 227/48; 227/99; 227/110; 227/152; 227/154

[58] Field of Search ..... 227/3, 48, 99, 227/100, 110, 111, 152, 154, 40, 101, 50, 29, 30, 151

[56] References Cited

U.S. PATENT DOCUMENTS

| | | | |
|---|---|---|---|
| 2,482,872 | 9/1949 | Rapport . | |
| 2,544,499 | 3/1951 | Hovey | 227/154 |
| 3,559,863 | 2/1971 | Sack et al. | 227/111 |
| 3,565,314 | 2/1971 | Fitch et al. | 227/48 |
| 3,576,286 | 4/1971 | Bunch | 227/99 |
| 4,039,112 | 8/1977 | Schultz . | |
| 4,175,313 | 11/1979 | Neumann . | |
| 4,258,873 | 3/1981 | Vela . | |
| 4,479,600 | 10/1984 | Albright . | |
| 4,486,264 | 12/1984 | McKernan | 227/48 |
| 4,876,787 | 10/1989 | Ditty et al. | 227/152 |
| 5,346,113 | 9/1994 | Cosden . | |

*Primary Examiner*—Scott A. Smith

*Attorney, Agent, or Firm*—Larson & Taylor, PLC

[57] ABSTRACT

A fully automated frame maker which makes rectangular frames includes a controller device for controlling a cycle of operation and preferably multiple cycles of operation to form a plurality of frames. The apparatus also broadly includes a framing device for cyclically feeding precut mitered frame members and for forming a rectangular frame therefrom. This framing device is controlled by the controller device which includes: a base defining a horizontal plane; four respective stands; a mounting device for mounting the four stands adjustably to the base such that each of the stands is located at an apex of a rectangle; a respective magazine device associated with each adjacent pair of the stands for holding precut mitered frame members in a vertical stack; a respective feed device for feeding one frame member from each stack of each respective magazine device onto adjacent pairs of the stands to form a loose frame; a respective clamp device for horizontally clamping together adjacent ends of each frame member on each respective stand simultaneously, the respective clamp devices together forming a tight rectangular frame from the loose frame; and a respective stapling device for vertically stapling together the ends of the frame members at each stand simultaneously in order to form a completed frame. In a preferred embodiment, the frame maker also includes a moving device controlled by the controller device for moving the completed frame away from the framing device so that another cycle of operation can commence.

15 Claims, 7 Drawing Sheets

AUTOMATIC FRAME MAKER

FIELD OF THE INVENTION

The present invention relates generally to the field of making rectangular frames for pictures, windows, and doors and the like, and more particularly to a device which produces the frames automatically.

BACKGROUND OF THE INVENTION

Picture frames which are made from miter cut lengths of stock material must be carefully positioned and attached together in order to provide an aesthetically satisfactory product. The needed operations are frequently performed by hand, which is both time consuming and labor intensive.

While various automated devices have been proposed for automatically forming frames, such devices have not been satisfactory and frequently still required significant labor. Examples of prior devices are disclosed in U.S. Pat. No. 2,482,872 (Rapport), U.S. Pat. No. 4,039,112 (Schultz), U.S. Pat. No. 4,175,313 (Neumann), U.S. Pat. No. 4,258,873 (Vela), U.S. Pat. No. 4,479,600 (Albright), and U.S. Pat. No. 5,346,113 (Cosden).

SUMMARY OF THE INVENTION

In accordance with the present invention, a fully automated frame maker is provided for making rectangular frames. The apparatus includes a controller means for controlling a cycle of operation in the making of a frame, which apparatus is continuously operated to form a plurality of frames. The apparatus also broadly includes a framing means for cyclically feeding precut mitered frame members or elements and for forming a rectangular frame therefrom. This framing means is controlled by the controller means and includes: a base defining a horizontal plane; four respective stands; a mounting means for mounting the four stands adjustably to the base such that each of the stands is located at an apex of a preselected size of a rectangle in a plane parallel to the horizontal plane of the base; a respective magazine means associated with each adjacent pair of the stands for holding precut mitered frame members in a vertical stack; a respective feed means for feeding one frame member from each stack of each respective magazine means simultaneously onto adjacent pairs of the stands to form a loose frame; a respective clamp means for horizontally clamping together adjacent ends of each frame member on each respective stand simultaneously, the respective clamp means together forming a tight rectangular frame from the loose frame; and a respective stapling means for vertically stapling together the ends of the frame members at each stand simultaneously in order to form a completed frame.

In a preferred embodiment, the apparatus also includes a moving means controlled by the controller means for moving the completed frame away from the framing means so that another cycle of operation can commence to form another frame. In addition, each stand includes a respective support table integral therewith. The respective support tables together provide a plane of support parallel to the horizontal plane of the base. Each of the support tables (a) receives the frame members fed by the feed means, (b) supports the frame members as the clamp means horizontally clamp the frame members together, and (c) supports the frame members as the stapling means staples the ends of the frame members together.

In the preferred embodiment, the apparatus further includes a respective press means for vertically pressing the ends of the frame members at each the support table against the respective stand simultaneously. In addition, each magazine means includes a width adjusting means for adjusting a horizontal width of the respective magazine means to selectively accommodate for when frame members of different widths are subsequently used. Each feed means also includes a release means for releasing one frame member from the associated stack while holding the remaining frame members in the stack, and the release means is adjustable to selectively accommodate when frame members of different heights are subsequently used. Each press means then includes a width adjusting means for adjusting a horizontal position of the respective press means to selectively accommodate for frame members of different widths and hence for joints to be pressed of different lengths, and each stapling means includes a position adjusting means for repeatedly adjusting a position of the respective the stapling means along the joint to provide a plurality of staples at selective positions along the joint and to accommodate for joints of different lengths.

More preferably, the stands are formed by first and second vertical plates, and respective support tables are located between associated first and second plates and include a central aperture. In addition, respective clamp means further include a respective actuator for moving the respective corner member, and each associated corner member and actuator are located between the associated first and second vertical plates. Further, respective press means are located between associated first and second plates above the associated support table, and respective stapling means are located between associated first and second plates below the associated central aperture of the associated support table. Still further, each magazine means includes first and second vertical chute members attached to adjacent vertical plates of adjacent stands to provide the horizontal width therebetween, the width adjusting means fixing the first chute member vertically to the vertical plate and fixing the second chute member adjustably to the vertical plate.

Each feed means preferably includes a bottom supporting device which supports a bottom surface of a lowermost one of the frame member at each second chute member and which is movable to a non-supporting position. A holding device then holds a second lowermost frame member in position at each second chute member when the bottom supporting device is moved to the non-supporting position, so that only the lowermost frame member is released from the stack. Prior to release, a moving device is used to grip the lowermost frame member, and then to move the released frame member onto and along the support table to a position to form the loose frame. Each holding device further includes an adjusting means for adjusting a holding position thereof to accommodate for when frame members having a different height are subsequently used.

In order to move the completed frame, the moving means preferably includes a gripper which grips one side of the completed frame. A transfer mechanism then reciprocally moves the gripper between a grip position where the completed frame is gripped and an ungripped position where the frame is released by the gripper. Finally, a conveyor is provided at the ungripped position which transports the completed frame away from the framing means.

In order to move the stands, the mounting means includes an anchor mounted on the base to which a first one of the stands is attached, the anchor defining X and Y axes radiating therefrom. A first bearing plate is then mounted for movement on the base along the X axis and to which a second one of the stands is attached. In addition, a second bearing plate is mounted for movement on the base along the Y axis and to which a third one of the stands is attached. Finally, a third bearing plate is mounted for movement on the base along both the X and Y axes and to which a fourth one of the stands is attached. To move the various plates, a first rack and gear mechanism is used for moving the first and third bearing plates simultaneously along the X axis, and a second rack and gear mechanism is used for moving the second and third bearing plates simultaneously along the Y axis.

It is an advantage of the present invention that picture frames and the like are easily and quickly made.

It is also an advantage of the present invention that, other than the manual loading of the feed means, the entire operation of the apparatus takes place automatically.

It is a further advantage of the present invention that the framing means is adjustable for different sizes of frame members, that is for length, width and height as desired to be used by the user.

It is a still further advantage of the present invention that the formed frame is automatically removed from the framing means.

Other features and advantages of the present invention are stated in or apparent from detailed descriptions of presently preferred embodiments of the invention found hereinbelow.

DESCRIPTION OF THE PREFERRED EMBODIMENTS

Figure 1:
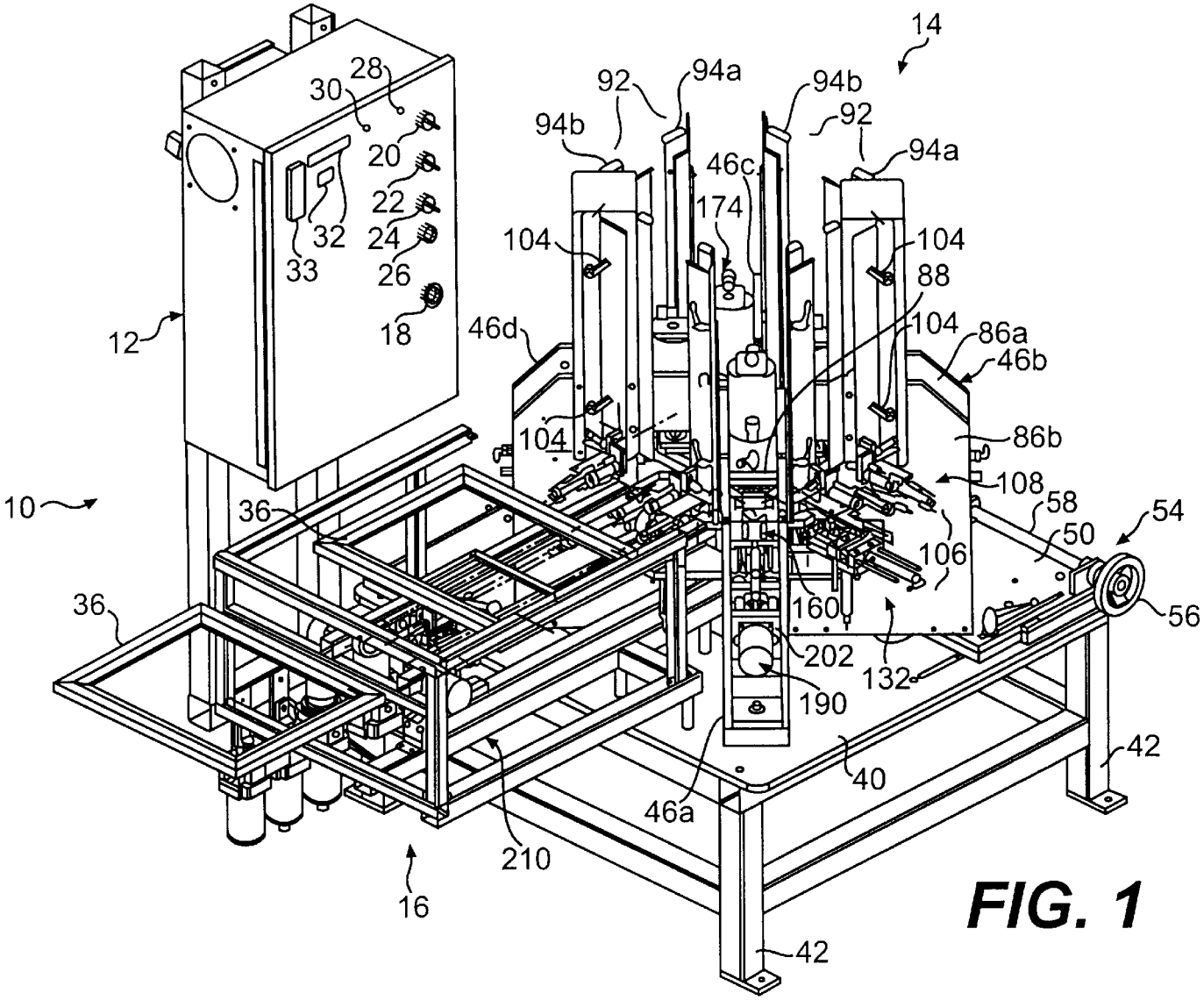
FIG. 1 is a schematic front, left side and top perspective view of the automatic frame maker of the present invention.

With reference now to the drawings in which like numerals represent like elements throughout the views, an automatic frame maker 10 is schematically depicted in FIG. 1. Broadly, frame maker 10 includes a controller means 12, a framing means 14, and a moving means 16. Controller means 12 is preferably a micro-computer or the like which controls all of the operations of framing means 14 and moving means 16 so that frames can be made in a cyclical manner one after another automatically and without manual supervision. Controller means 12 includes an emergency stop button 18, a main control (off/on) switch 20, a mode (jog/auto) switch 22, a stop/run switch 24, and a cycle start button 26—the functions of which are all self-explanatory in view of the operation of the device as discussed hereafter so that no further discussion is needed. Preferably, a run light 28 and fault light 30 are also provided for the operator to view, as well as other LED or the like displays 32 (such as for the number of frames made during the present run). An input pad 33 is provided adjacent displays 32 for the input of suitable data (such as frame joint length or number of staples to be provided along the joint length) as prompted by controller means 12 or other input as desired. It will be appreciated that controller means 12 controls both electronic signals and pneumatic actuations as necessary for framing means 14 and moving means 16, as will be apparent from the discussions hereafter.

Framing means 14 is controlled by controller means 12 to cyclically feed precut mitered members 34 (omitted for clarity, except for FIG. 4 where two are partially shown schematically with broken lines) and to form a completed rectangular frame 36 therefrom. It will be appreciated that framing means 16 is designed to form frames 36 of various sizes as determined by the frame members sizes used, typically from 5×7 inch frames to 11×17 inch frames, but up to poster size frames (or where appropriate window and door frames) as desired by the user. The adjustments to framing means 14 to accommodate various sizes of frame members 34 in all three dimensions (length, width and height) prior to running frame maker 10 will be discussed hereafter.

Figure 2:
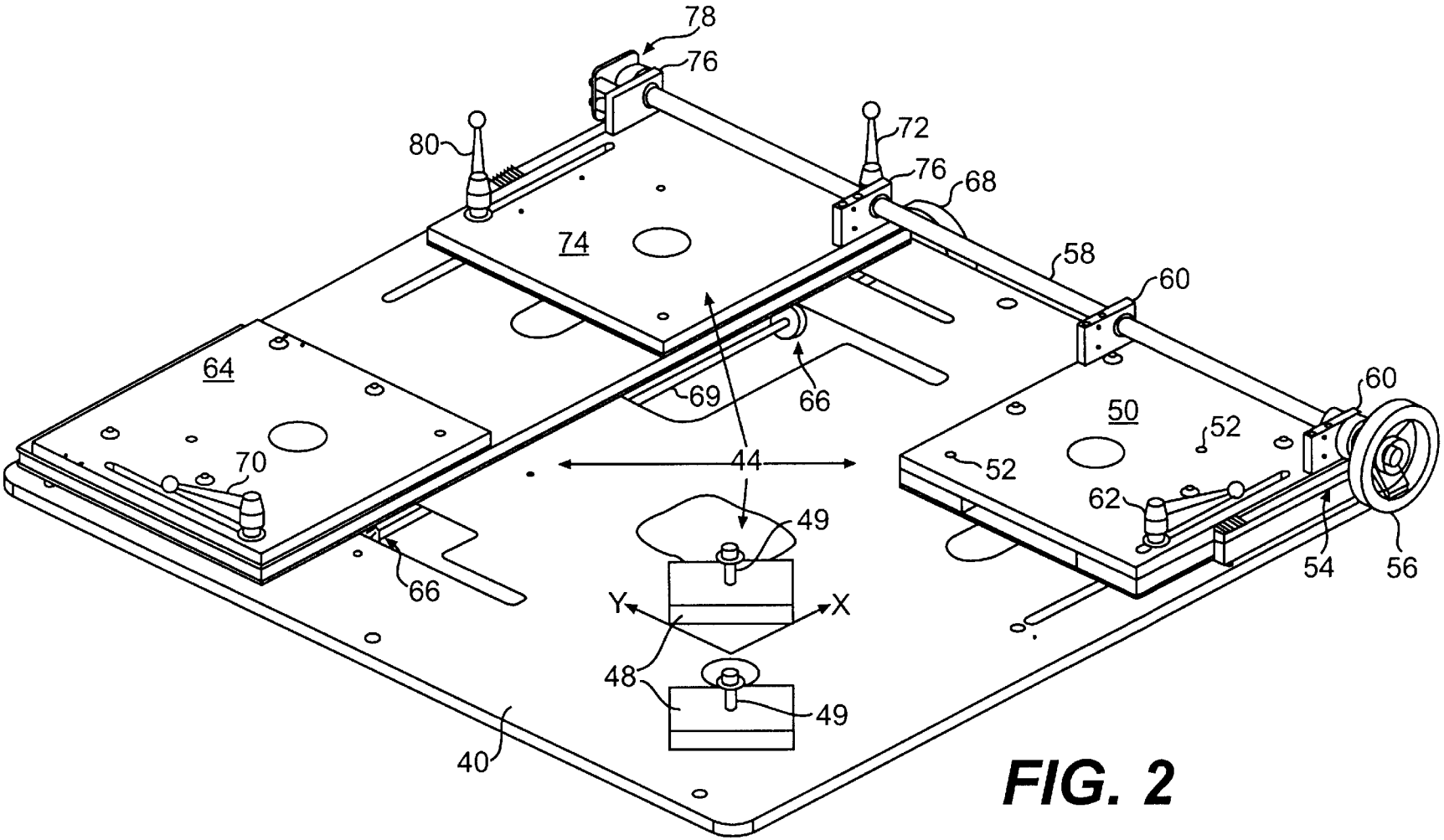
FIG. 2 is a schematic front, left side and top perspective view of the base and stand mounting means of the automatic frame maker depicted in FIG. 1.

As best shown in FIG. 2, framing means 14 includes a base 40, typically provided on top of legs 42 to provide a convenient height for the user. Base 40 defines a horizontal plane and has mounted thereon a mounting means 44 which mounts four stands 46 adjustably to base 40. Mounting means 44 mounts stands 46 (not shown in FIG. 2 and discussed subsequently hereinbelow) at respective apexes of a preselected size of rectangle (or frame) in a plane parallel to the horizontal plane of base 40. For one stand 46*a*, mounting means 46 includes respective anchors 48 and screws 49 by which stand 46*a* is immovably mounted to base 40. It will thus be appreciated that stand 46*a* defines one apex of the rectangle, and the (arbitrary) X and Y axes of the rectangle referred to hereafter.

Mounted for smooth and precise movement on base 40 parallel to the X axis is a first bearing plate 50. First bearing plate 50 includes two holes 52 therein by which a second stand 46*b* is attached thereto by suitable screws (not shown). First bearing plate 50 is moved parallel to the X axis by a first rack and gear mechanism 54 having a crank handle 56 mounted on a cylindrical bar 58 by which the gear is turned. It will be appreciated that bar 58 extends through two bearing brackets 60 mounted on first bearing plate 50 to move first bearing plate 50 parallel to the X axis. When the desired position of first bearing plate 50 is achieved relative to stand 46*a*, first bearing plate 50 is locked in place by use of a quick release handle 62 as well known in the art. As will be appreciated subsequently, the position of first bearing plate 50 is used to adjust framing means 16 to the specific X axis size of frame 36, or rather to the precut frame members 34 to be used to form that side of frame 36.

Mounted for smooth and precise movement on base 40 parallel to the Y axis is a second bearing plate 64. Second bearing plate 64 also includes two holes 52 therein by which a third stand 46*c* is attached thereto. Second bearing plate 64 is moved parallel to the Y axis by second rack and gear mechanisms 66 located underneath of base 40 and having a crank handle 68 and bar 69 associated therewith. It will be appreciated that second bearing plate 64 extends along most of the length of base 40 in the X direction. When the desired position of second bearing plate 64 is achieved relative to stand 46*a*, second bearing plate 64 is locked in place by use of a quick release handles 70 and 72 located at opposite ends thereof. As will be appreciated subsequently, the position of second bearing plate 64 is used to adjust framing means 16 to the specific Y axis size of frame 36.

Riding on top of second bearing plate 64 so as to be movable along both the X and Y axes is a third bearing plate 74. Third bearing plate 74 similarly includes holes 52 therein by which a fourth stand 46*d* is attached thereto. As shown, bar 58 extends through aligned bearing brackets 76 mounted on third bearing plate 74 as well, and there is another part 78 of first rack and gear mechanism 54 provided at the far bearing bracket 76 through which bar 58 movably (in the Y direction) extends. It will thus be appreciated that third bearing plate moves in the X direction together with first bearing plate 50, and in the Y direction together with second bearing plate 64. Third bearing plate 74, and hence stand 46*d* thereon, is automatically adjusted for both the X and Y size of frame 36 as the adjustments for first bearing plate 50 and second bearing plate 64 are made. Third bearing plate 74 also includes a quick release handle 80 to lock third bearing plate 74 against movements in the X direction. Quick release handle 80 is thus used in conjunction with the locking of quick release handle 62 to lock both first bearing plate 50 and third bearing plate 74 against movement in the X direction once the proper sizing has been achieved.

Figure 3:
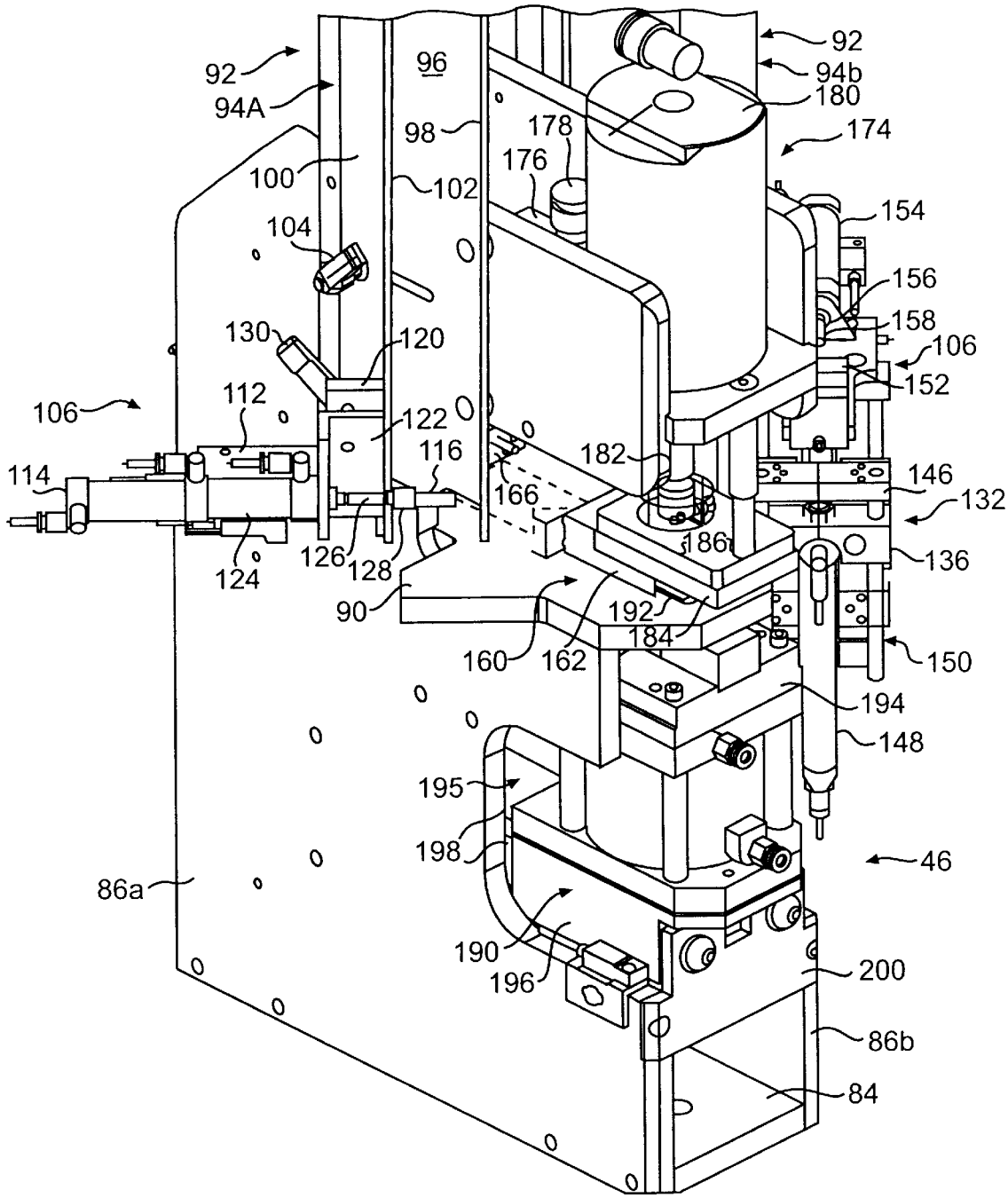
FIG. 3 is a schematic front, left side and top perspective view of one of the stands of the automatic frame maker depicted in FIG. 1.
Figure 4:
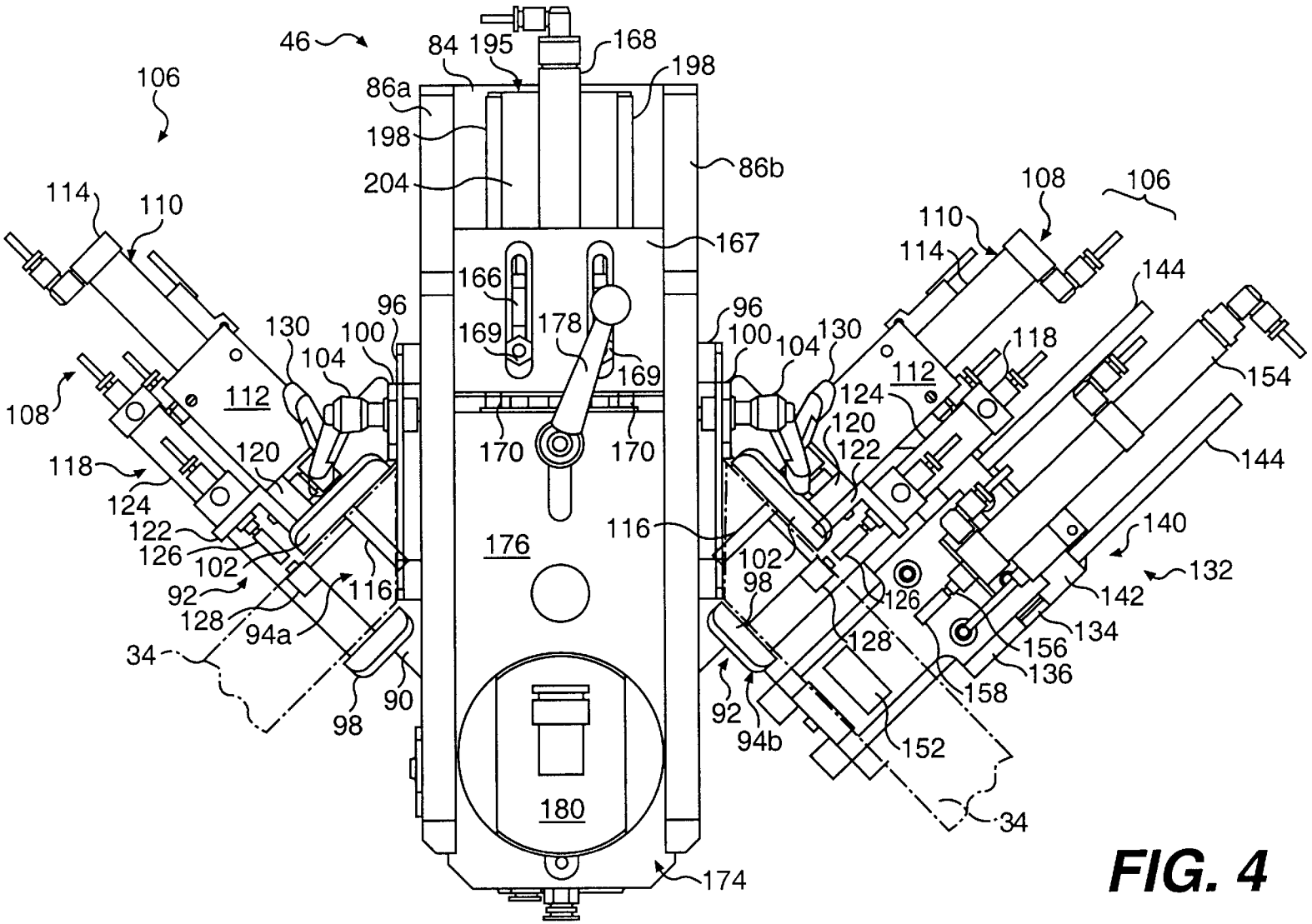
FIG. 4 is a schematic top plan view of the stand depicted in FIG. 3.
Figure 5:
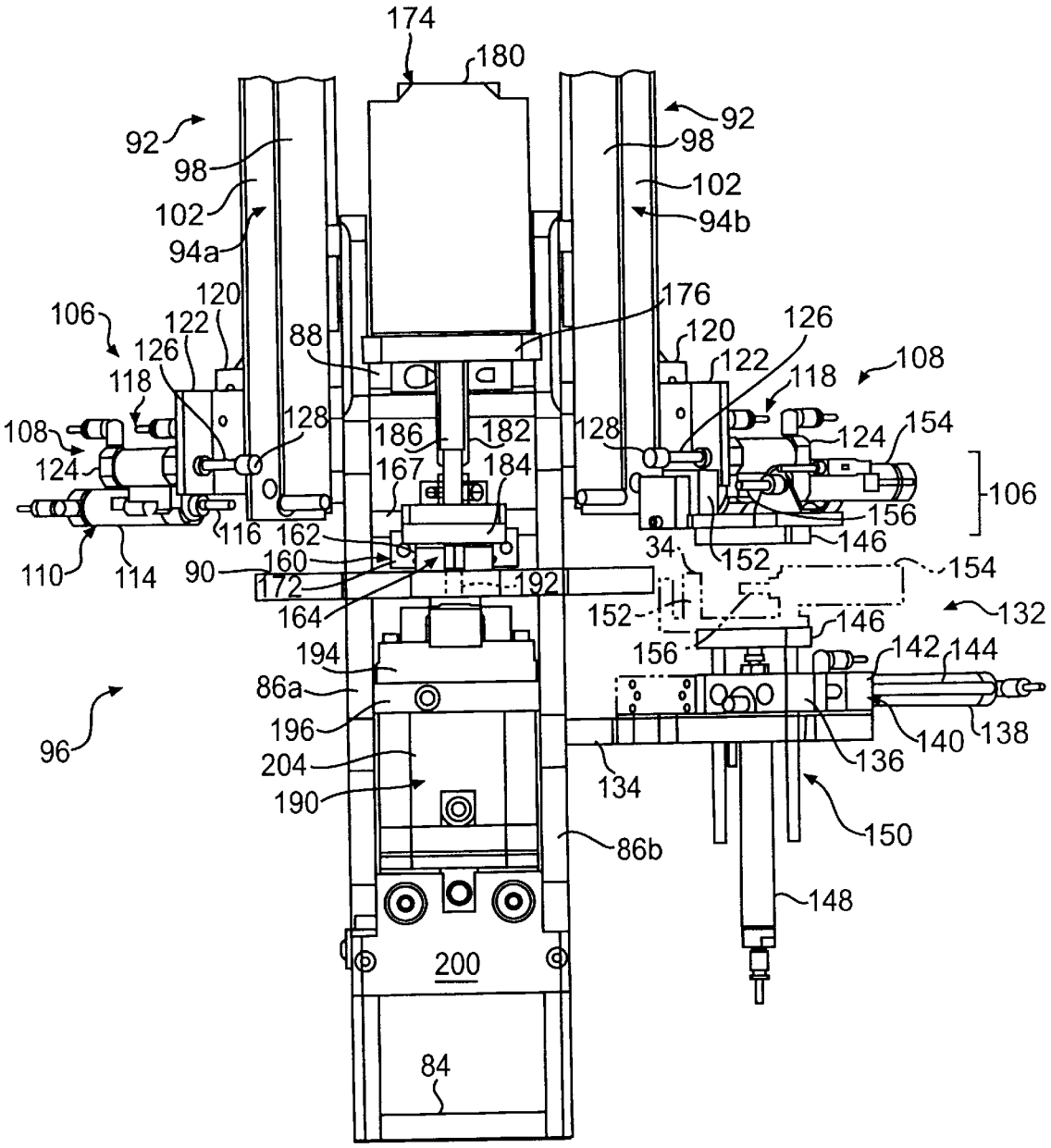
FIG. 5 is a schematic front elevation view of the stand in FIG. 3

Depicted in FIGS. 3–5 is a respective stand 46 which is exemplary of all four stands 46*a*, 46*b*, 46*c* and 46*d*. Stand 46 includes a base plate 84 by which stand 46 is attached to anchors 48 or plates 50, 64 or 74, as by screws 49. It will be appreciated that the longitudinal axis of base plate 84 extends at a 45° angle to the X and Y axes so that the longitudinal axis thereof is parallel to a joint line of the ends of the frame member to be joined thereabove. Attached at the longitudinal sides of base plate 84 and parallel to the longitudinal axis of base plate 84 are respective first and second vertical plates 86*a* and 86*b*. A top plate 88 connects vertical plates 86*a* and 86*b* together above base plate 84. Attached between vertical plates 86*a* and 86*b* and parallel to base 40 is a support table 90. Support table 90 is provided at the location of front cutouts provided in vertical plates 86*a* and 86*b*, and support table 90 also extends outward on either side of vertical plates 86and and 86*b* as shown to provide a plane of support parallel to the horizontal plane of base 40.

Attached to the outside of adjacent vertical plates 86*a* and 86*b* of adjacent stands 46 are respective magazine means 92. Magazine means 92 are designed to hold a stack of the precut mitered frame members 34 in a vertical plane above each support table 90 of the adjacent stands 46, and with the frame member parallel to an associated X or Y direction (that is at a 45° to the associated vertical plate 86). It will thus be appreciated that each magazine means 92 includes first and second vertical chute members 94*a* and 94*b* located on adjacent stands 46, so that chute members 94*a* and 94*b* depicted in FIGS. 3–5 belong to different magazine means 92. It will also be appreciated that chute members 94*a* and 94*b* are identical, so that only chute member 94*a* will be described in detail. Chute member 94*a* includes a main backing plate 96 mounted spaced from but parallel to vertical plate 86*a*. Backing plate 96 has a flanged edge 98 which extends parallel to the associated X or Y direction of the disposition of the frame member 34 held thereby. Mounted to main backing plate 96 is an adjustment plate 100 having a flanged edge 102 extending parallel to flanged edge 98.

As best shown in FIG. 4, edges 98 and 102 together with the outer face of main backing plate 96 serve to hold the mitered end of frame member 34 precisely in place; and, in conjunction with the other chute member 94*b* on the adjacent stand 46, chute members 94*a* and 94*b* securely hold a plurality of identical frame members 34 securely in a vertical stack. It will be appreciated that adjustments of stands 46 relative to one another provide an adjustment for the longitudinal length of frame members 34, and that the X and Y lengths of frame members 34 need not be equal—and obviously are not for a rectangular frame 36. It will also be appreciated that adjustment plate 100 is adjustably secured to backing plate 96 by use of two quick release handles 104 and associated slots in backing plate 96. Thus, the width of frame members 34 is adjusted for by moving adjustment plate 100 along backing plate 96 as required. Preferably, such adjustments accommodate frame member 34 widths of about ½" to 1½" for most applications, but the width adjustment could be up to 7: or 8" for some applications.

For each stack of frame members 34 in each magazine means 92, there is a respective feed means 106. Each feed means 106 is used for feeding one frame member 34 from each stack of each magazine means 92 simultaneously with the other feed means 106, onto adjacent pairs of support tables 90. This results in each support table 90 having two mitered ends of adjacent frame members 34 positioned thereon, so that all four of the frame members 34 now positioned on supports tables 90 form a loose (unfastened and still separated) generally rectangular frame. Each feed means 106 preferably includes a release means 108 for releasing one frame member 34 at a time from the associated stack, while holding the remaining frame members 34 in the stack. In addition, as will be explained subsequently, each release means 108 is also adjustable to accommodate different heights of frame member 34.

In the preferred embodiment, each release means 108 includes a bottom supporting (gate) device 110 at each chute member 94*a* and 94*b* which supports a bottom surface of a lowermost one of frame members 34 in the associated stack. As each supporting device 110 is identical, only one will be described in detail. As shown, supporting device 110 includes an L-shaped mounting plate 112 which is secured to flanged edge 102 of adjustment plate 100, so as to moved therewith. Attached to mounting plate 112 is a pneumatic actuator 114 which moves a rod 116 reciprocally between a position at the bottom of chute 94*a* or 94*b* to a position withdrawn into actuator 114 and not at a position at the bottom of the chute. It will thus be appreciated that when rod 116 is in position at the bottom of chute 94*a* or 94*b*, the stack of frame members 34 rests or is supported thereon, whereas in the withdrawn position rod 116 does not support the stack. It will also be appreciated that when adjustment plate 100 is moved to adjust for the width of frame members 34, bottom supporting device 110 is moved therewith.

In order to release one frame member 34 at a time from the stack, release means 108 also includes a holding device 118. Holding device 118 is used to hold a second lowermost frame member 34 in position at each chute member 94*a* or 94*b* when rod 116 of supporting device 110 is moved to the non-supporting position. Holding device 118 includes a stationary bracket 120 secured and extending out from flanged edge 102. Attached to first bracket 120 is an L-shaped bracket 122, to one leg of which is attached a pneumatic actuator 124. Actuator 124 includes a rod 126 with a rubber end (or the like) 128. L-shaped bracket 122 is adjustably attached to stationary bracket 120 by a quick release handle 130, so that L-shaped bracket 122 is adjustable vertically.

Feed means 106 preferably also includes a respective moving device 132 associated with each respective magazine means 92. Each moving device 132 is designed to move frame member 34 which has released by associated release means release means 108 from the stack and onto adjacent support tables 90 at a position relative to the other frame members in the other magazine means 92 so that a loose frame is made of the four frame members 34. For this purpose, each moving device 132 includes a support bracket 134 attached to vertical plate 86*b* and extending horizontally therefrom as a 45° elbow. Mounted to support bracket 124 is a first base 136 which is movable above support bracket 134 in a horizontal direction perpendicular to a line drawn between the adjacent stands 46 and hence perpendicular to a longitudinal axis of frame member 34 resting on support tables 90 adjacent moving device 132. First base 136 is moved by a pneumatic actuator 138 mounted to the 45° elbow portion of support bracket 134 and having a guide means 140 formed of a guide bracket 142 and guide rods 144 as known in the art. Mounted for movement with first base 136 is a second base 146 (shown in phantom in FIG. 5 parallel to the longitudinal axis of frame member 34 thereabove and in full lines in a raised position shown detached from first base 136). Second base 146 is mounted to first base 136 so as to be movable vertically relative to first base 136 by means of a pneumatic actuator 148 mounted to first base 136 and having a guide means 150 similar to guide means 140. Mounted at an inner end of second base 146 is a stop 152, opposite to which and mounted at the outer end of second base 146 is a pneumatic actuator 154. Actuator 154 includes a rod 156 with a rubber end 158 movable toward and away from stop 156.

When it is desired to release one frame member 34 from the stack being held by bottom supporting device 110, actuator 124 is actuated to move rod 126 so that end 128 horizontally presses the second lowermost frame member 34 firmly against flanged edge 98, whereby the stack above the second lowermost frame member 34 is supported by the second lowermost frame member 34. Actuator 148 of moving device 132 is then (or preferably simultaneously) actuated to move second base 146 to a position where actuator 154 traps the lowermost frame member 34 between end 158 and stop 152. Actuator 114 is then actuated to move rod 116 from the supporting position to the non-supporting position, allowing the lowermost frame member 34 to be initially held by moving device 132. Once the lowermost frame member has been gripped and moved away, actuator 114 again moves rod 116 to the supporting position and actuator 124 moves rod 126 to the non-holding position so that rod 116 again supports a lowermost one of the stack of frame member 34. It will be appreciated that by making the position of L-shaped bracket 122 adjustable relative to stationary bracket 120 and hence stationary to flanged edge 102, the vertical position of rod 126 is adjustable to properly position rod 126 for whatever height of frame member is presented. It will also be appreciated that the lowermost frame member 34 is positioned from the top surface of support table 90 by a short distance equal at least to the height of frame member 34 (to provide removal clearance of the completed frame 36 as explained subsequently) onto an outer portion of support table 90.

Prior to rising and gripping the lowermost frame member 34, moving device 132 is initially positioned out of the way of operation of feed means 106 associated therewith. After rising and gripping the lowermost frame member 34 as noted above, actuator 148 is actuated to cause second base 146 to lower the lowermost frame member 34 now gripped to a level of the top surface of support table 90. At the same time, actuator 138 is actuated to move the trapped frame member perpendicular to its axis a predetermined distance and hence into a loose frame position with the other three frame members similarly moved. Once in position, the trapped leg is released and moving device 132 is returned to its initial position.

Figure 6:
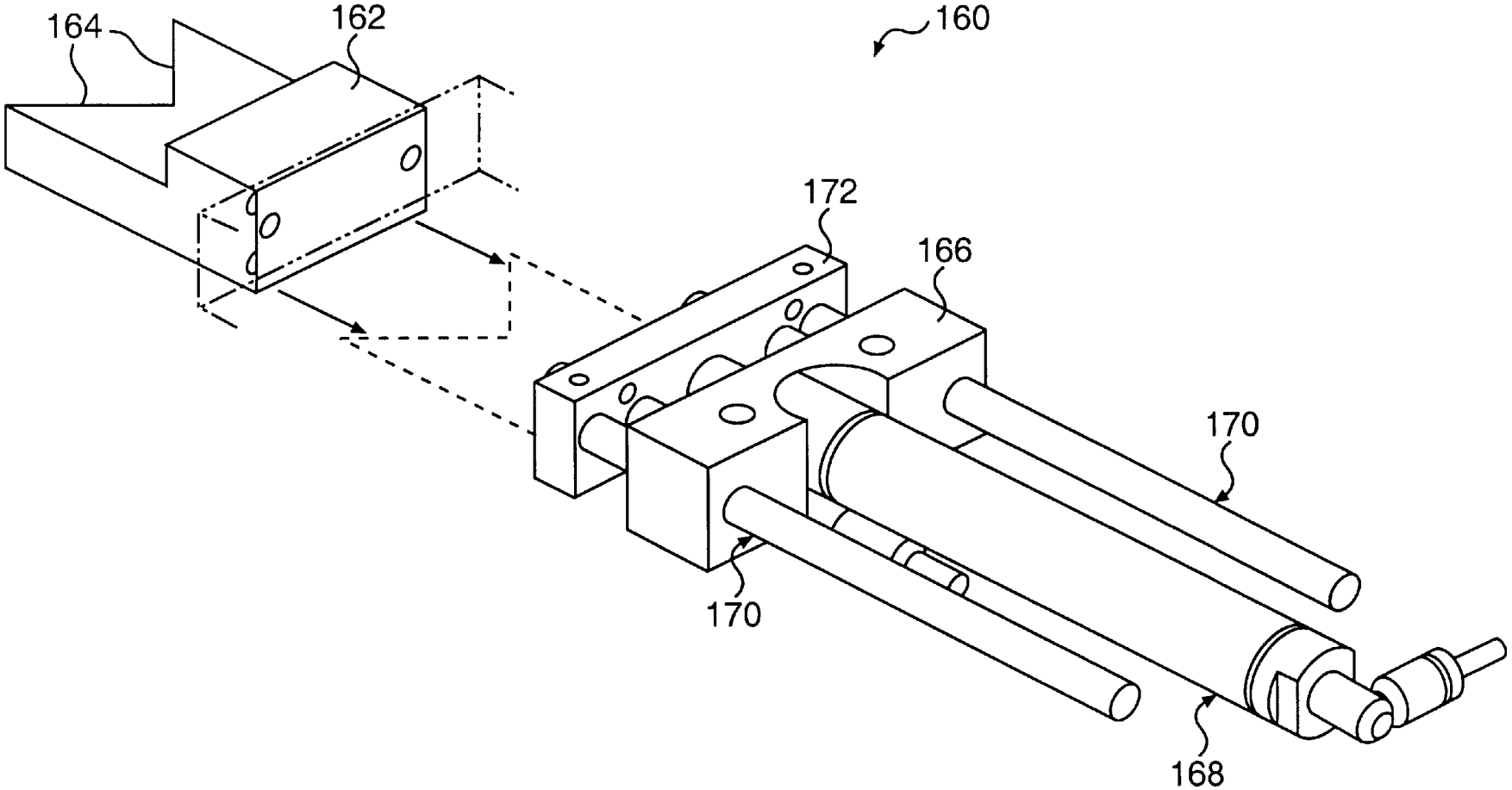
FIG. 6 is a schematic top, side and rear view of the clamp means depicted in FIG. 3.

After the loose frame of frame member 34 is formed on support tables 90, a clamp means 160 is used to securely clamp the adjacent mitered ends of the loose frame horizontally together at each stand 90 into a tight rectangular frame. As shown in FIG. 6, each clamp means 160 includes a corner member 162 which has a 90° angled face 164 by which adjacent ends of the frame member 34 are pressed together (in conjunction wit the other clamp means 160 at each stand 46) to form the tight corner of the completed frame 36. Corner member 162 is mounted between vertical plates 86*a* and 86*b* by use of a block 166 attached to a cross brace 167 mounted to adjacent portions of vertical plates 86*a* and 86*b* and above an outside top portion of support table 90. Block 166 is adjustably mounted to cross brace 167 by suitable bolts 169, and block 166 mounts a pneumatic actuator 168 and a guide means 170 therefor for horizontal movement of a head 172 parallel to the joint line between the ends of frame member 34. Attached to head 172 is corner member 162 which is thus moved along the top face of the associated support table 90 between an inner engaged position (shown in full lines) and an outer non-engaged position (shown in schematic dashed lines) by actuator 168. It will be appreciated that corner member 162 is normally held in the non-engaged position out of the way of the other elements of stand 90, and in only brought into position once frame members 34 are located in the loose frame position. It will also be appreciated that all four of clamp means 160 are actuated at the same time, so all of the horizontal forces on the ends of all four frames members are balanced and together act to press the ends of frame members 34 at each support table 90 together with a uniform pressure.

Once frame member 34 is formed into a tight frame, a press means 174 is used to vertically press the adjacent ends of frame member 34 against the associated support table 90. Each press means 174 includes a base plate 176 mounted for sliding movement horizontally along top plate 88 and base plate 176 is adjustably held in the desired place by a quick release handle 178. Mounted to base plate 176 is a pneumatic actuator 180 with a rod 182 extending downwardly therefrom. Attached to rod 182 is a horizontal press plate 184. The up and down movement of press plate 184 by actuator 180 is guided by a guide member 186. The horizontal position of press plate 184 is longitudinally adjusted by movement of base plate 176 along top plate 88 to position press plate 184 immediately above the center of the joint length of the ends of frame member 34 to be joined together in order to adjust for frame member 34 of different widths and hence of different joint lengths. Press plate is pressed into the ends of frame member 34 with a pressure of about 600 pounds in order to secure the ends of frame member 34 vertically in place against a nailing force and directly opposite the nailing force or forces exerted (as explained subsequently).

In order to secure the ends of frame member 34 together into a completed frame 36, a stapling means 190 is provided at each stand 46. Stapling means 190 is located beneath support table 90 and is used to staple suitable V-shaped nails into the adjacent ends of frame member 34 thereabove. V-shaped nails are used because, as nails of this shape are driven into the frame member 34 ends, the nails act to horizontally press the ends together—and after insertion, the nails of course also permanently hold the ends together. To accommodate for access of press means 190 to the ends of frame members 34, support table 90 includes a suitable aperture 192 therein along the position of the joint line of the ends of frame member 34 (see FIG. 3). It will thus be appreciated that the significant force used to drive the nails into the ends of frame member 34 is opposed vertically by press means 174 which is preferably optimally located centrally along the joint line.

Stapling means 190 includes a suitable stapling device 194, such as those commercially made by Gleason Brothers Industries, Inc. (of St. Albans, VE), ITW Amp, and Pistorius Machine Company (of Hauppauge, N.Y.) and a positioning means 195. Stapling device 194 is mounted to a base plate 196 so as to be located just below aperture 192 in support table 90, but with the stapling head located in aperture 192 just below the top surface of support table 90. Base plate 196 is reciprocally mounted by positioning means 195 which includes guides 198 on which base plate 196 is mounted, which guides 198 are in turn mounted between vertical plates 86*a* and 86*b* by a front plate 200 and a back plate 202 attached to vertical plates 86*a* and 86*b*. Base plate 196 is adjustably moved parallel to the joint line of the ends of frame member 34 by positioning means 195 which also includes a stepper motor 204, so that by suitable actuation of stepper motor 204 the horizontal position of the head of stapling device 194 is similarly moved to desired locations along the length of aperture 192. By repeated actuation of stapling device 194 after movement of base plate 196 by stepper motor 204, a plurality of nails can be driven into the ends of frame member 34 at different positions along the joint line as desired—but obviously if frame member 34 has a small width and only one nail is needed, stapling device is simply positioned once and remains stationary. The number and positions of the nails is preferably preselected by suitable programming of controller means 12.

Figure 7:
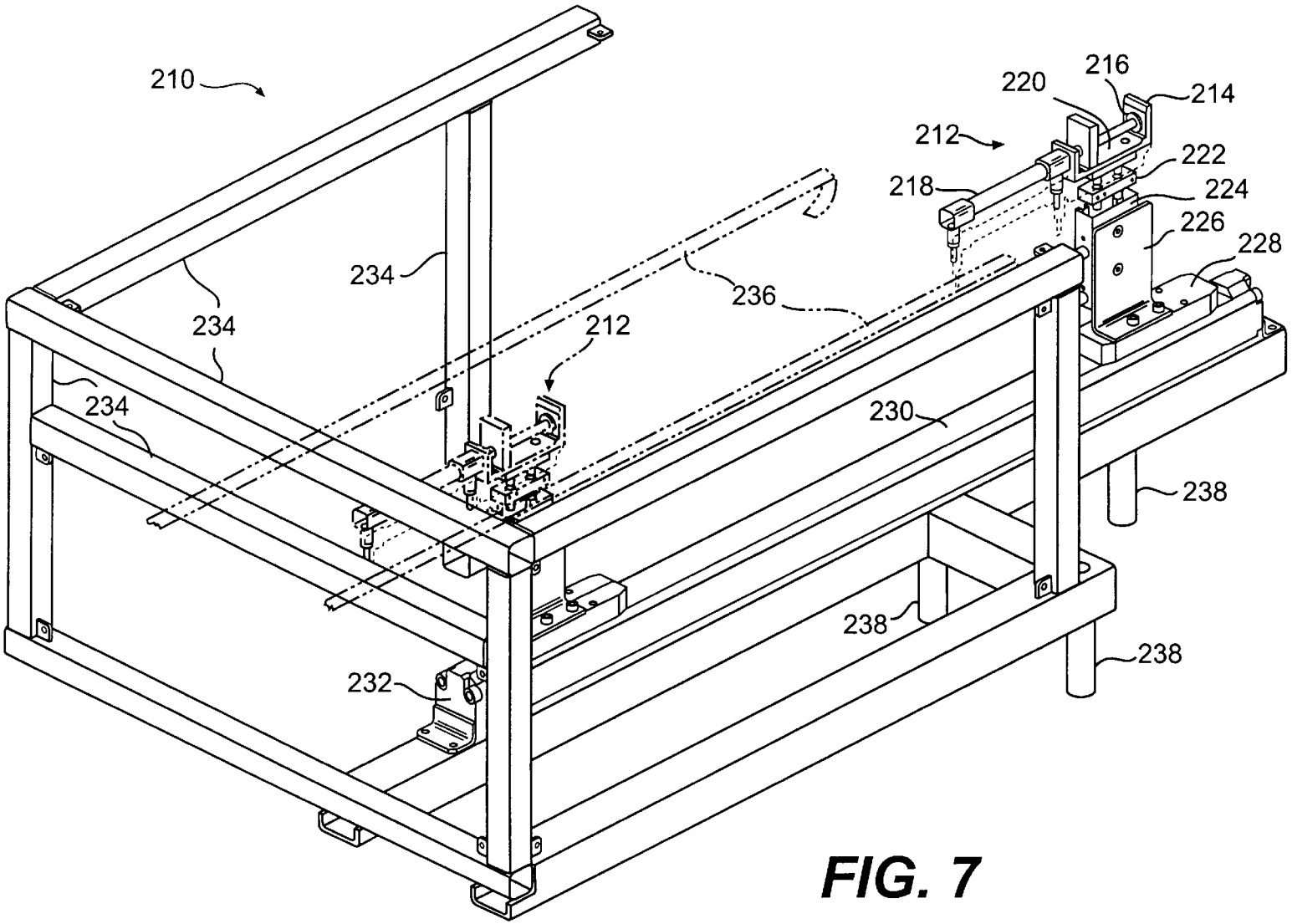
FIG. 7 is a schematic top, front and side view of the moving means depicted in FIG. 1.

Once stapling means 190 has been actuated the desired number of times to drive the V-shaped nails into the adjacent ends of frame member 34 at all stands 90, the completed frame 36 has been made. At that time, clamp means 160 and press means 174 are returned to the non-engaging positions. As shown in FIG. 7, a moving means 210 controlled by controller means 12 is then used to automatically remove competed frame 36 from between two predetermined adjacent stands 90 as shown in FIG. 1 so that another cycle of operation can be performed. Moving means 210 is similar in action to moving device 132 and includes a gripper 212 which grips one frame member 34 of completed frame 36. Gripper 212 includes a stop 214 against which one side of frame member 34 is pressed by an end 216 of a pneumatic actuator 218 mounted to a bracket 220. Bracket 220 is vertically movable by being attached to a base 222, which in turn is attached to an end of a guided actuator 224. The main movement of gripper 212 is between a raised position (shown in full on the right side of FIG. 7) and a lowered position (shown in phantom lines on the right side of FIG. 7). Actuator 224 is in turn mounted by an L-shaped bracket 226 to a base 228 movable along track 230 by a rodless linear actuator 232. Track 232 is attached to a framework 234 which in turn is attached to base 40 by legs 238. Framework 234 also supports two tandem belt conveyors 236 or the like which are well know in the art, and it will be appreciated that only the belts have been depicted with a broken line for clarity. In practice, conveyors 236 would feed completed frames 36 to another conveyor or to a stacker as desired.

In operation, moving means 210 functions in the following manner. After completed frame 36 has been released by clamp means 160 and press means 174, gripper 212 is moved from a lower storage position beneath the plane of support tables 90 at a position immediately below the adjacent frame member 34 of completed frame 36 to a raised gripping position. In the lower storage position, it will be appreciated that end 216 of pneumatic actuator 218 is withdrawn from stop 214. After gripper 212 is raised, the adjacent frame member 34 is positioned between stop 214 and end 216, at which time pneumatic actuator 218 is activated to press end 216 against the adjacent frame member and hence against stop 214 to hold frame member 34 securely thereto. Actuator 232 is then actuated to move gripper 212 from the raised gripping position horizontally away from support stands 90 to a raised ungripping or release position shown in phantom at the left side of FIG. 7. As this movement occurs, completed frame 36 is dragged across the top surfaces of support tables 90 and onto conveyors 236. Once gripper 212 reaches the raised release position, end 216 is moved away from stop 214 to release frame member 34 of completed frame 36 held thereby, and then gripper 212 is moved to a lowered released position and subsequently moved back to the lower storage position. As soon as gripper 212 is lowered, conveyors 236 are activated to move completed frame 36 away from framework 234 as desired by the user (preferably to another conveyor for further conveyance to a storage area).

In operation, automatic frame maker 10 functions broadly in the following manner. Initially, stands 46*a–d* must be properly positioned for the two (length and width or X and Y) sizes of frame 36 to be made. As noted above, this is accomplished using handles 56 and 68 of the associated rack and gear mechanisms 54 and 66. After proper placement is achieved, bearing plates 50, 64 and 74 are locked in place using quick release handles 62, 70, 72 and 80. Next, the width of all magazine means 92 must be adjusted for the width of frame member 34 to be received therein. This is accomplished at each chute member 94*a* and 94*b* by adjusting the positions of each adjustment plate 100 relative to the associated backing plate 96, which is then locked in place by quick release handles 104 associated therewith. As noted above, this moves each flanged edge 102 away from flanged edge 98 to accommodate the width of frame member 34. The height of frame member 34, must also be accommodated by the proper positioning holding devices 118 of each chute member 94*a* and 94*b*. This is accomplished by moving each holding devices 118 relative to L-shaped bracket 122 attached to flanged edge 102 associated therewith, and locking holding devices 118 in place using each associated quick release handle 130.

Prior to operation, controller means 12 of automatic frame maker 10 must also be suitable programmed or set to accomplished the desired operations. In addition, by knowing the length of the joint line of the ends of frame member 34, the operator also sets the positions and number of nails to be driven into the ends of frame member 34 at each joint line. Typically, nails are positioned every ¼" to ½" depending on the length of the joint line available. A speed of operation and duration of operation can also be set if required or desired. Conveniently, diagnostics or the like are also part of controller means 12 as part of a setup routine.

After controller means 12 is suitably programmed and automatic frame maker 10 properly positioned for the sizes of frame member 34, the proper size of frame members 34 (width or length) is then loaded into stacks in associated magazine means 92 by the user. Once this is accomplished, controller means 12 is activated to begin operation (either in steps by using the jog button for a test operation, or one or more cycles of operation as desired). A cycle of operation begins with the delivery of one frame member 34 simultaneously from each magazine means 92 by an associated feed means 106 onto support tables 90 as described above. Associated moving devices 132 then simultaneously move each frame member closer together to form a loose frame. The loose frame is then gathered into a tight frame by simultaneous use of clamp means 160 at each corner. The ends of the tight frame are next pressed down simultaneously onto the associated support table by an associated press means 174, so that the associated staple means can then simultaneously insert one or more V-nails into the adjacent frame ends to secure the four frame members 34 simultaneously into a completed frame 36. After simultaneous withdrawal of press means 174 and clamp means 160, moving means 210 grips one side of completed frame 36 and moves completed frame 36 onto belt conveyors 236 for delivery as desired by the user. As selected by the user, another cycle of operation then commences as soon as completed frame 36 has cleared all support tables 90.

It will be appreciated that the various actuators used with automatic frame maker 10 typically include sensors (and typically Hall effect sensors) which indicate whether a proper actuation thereof has occurred. Such sensors are also connected to controller means 12 to signal that a desired action (extension or retraction) has taken place and that the next action should then take place. If a desired action does not take place, then controller means 12 would then issue some sort of signal, as by fault light 30, and stop the current cycle of operation until the problem is fixed. Preferably, the lack of a signal from the sensor would also cause a signal of the source of the problem to be indicated as well. Such operations are well appreciated by those of ordinary skill.

As automatic frame maker 10 includes a number of pneumatic actuators, it may be desirable to include an air accumulator below base 40 to prevent the source from being lowered by rapid operation of a number actuators. In addition, while V-shaped nails are preferably used, other nails such as U-shaped nails could also be used. Further, different actuators from those disclosed could be used so long as the operations were similarly accomplished. Similarly, mechanical equivalents well know in the art to those mechanical elements used can also be substituted for the disclosed elements without departing from the invention. It will also be appreciated that various types of frame member besides picture frame member can be used, so that the present invention could be used for making door or window frames as well as other such frames.

For safety, covers to protect the user from the actions of frame maker 10 should also be provided. Such covers would preferably cover framing means 14 while leaving chutes members 94*a* and 94*b* open and cover moving means 14 as necessary and convenient.

While the present invention has been described with respect to exemplary embodiments thereof, it will be understood by those of ordinary skill in the art that variations and modifications can be effected within the scope and spirit of the invention.

I claim:

1. An apparatus for automatically producing rectangular frames comprising:

a controller means for controlling a cycle of operation;

a framing means for cyclically feeding precut mitered frame members and for forming a rectangular frame therefrom, said framing means being controlled by said controller means and including:

a) a base defining a horizontal plane, b) four respective stands, c) a mounting means for mounting said four stands adjustably to said base such that each of said stands is located at an apex of a preselected size of a rectangle in a plane parallel to the horizontal plane of said base, d) a respective magazine means associated with each adjacent pair of said stands for holding precut mitered frame members in a vertical stack, e) a respective feed means for feeding one frame member from each stack of each said respective magazine means simultaneously onto adjacent pairs of said stands to form a loose frame, f) a respective clamp means for horizontally clamping together adjacent ends of each frame member on each respective said stand simultaneously, said respective clamp means together forming a tight rectangular frame from the loose frame, and g) a respective stapling means for vertically stapling together said ends of said frame members at each said stand simultaneously in order to form a completed frame.

2. An apparatus for producing frames as claimed in claim 1, and further including a moving means controlled by said controller means for moving the completed frame away from said framing means so that another cycle of operation can commence to form another frame.

3. An apparatus for producing frames as claimed in claim 2, wherein each said stand includes a respective support table integral therewith and said respective support tables together provide a plane of support parallel to the horizontal plane of said base, said support tables (a) receiving the frame members fed by said feed means, (b) supporting the frame members as said clamp means horizontally clamp the frame members together, and (c) supporting the frame members as said stapling means staples the ends of the frame members together.

4. An apparatus for producing frames as claimed in claim 3, and further including a respective press means for vertically pressing said ends of said frame members at each said support table against the respective said stand simultaneously.

5. An apparatus for producing frames as claimed in claim 4, wherein each said magazine means includes a width adjusting means for adjusting a horizontal width of the respective said magazine means to selectively accommodate for frame member of different widths.

6. An apparatus for producing frames as claimed in claim 5, wherein each said feed means includes a release means for releasing one frame member from the associated stack while holding the remaining frame members in the stack, said release means being adjustable to selectively accommodate for frame member of different heights.

7. An apparatus for producing frames as claimed in claim 6, wherein each said press means includes a press member which engages the ends of the frame member and a width adjusting means for adjusting a horizontal position of the respective said press member to selectively accommodate for frame member of different widths and hence for joints to be pressed of different lengths.

8. An apparatus for producing frames as claimed in claim 7, wherein each said stapling means includes a position adjusting means for repeatedly adjusting a position of the respective said stapling means along the joint to provide a plurality of staples at selective positions along the joint and to accommodate for joints of different lengths.

9. An apparatus for automatically producing rectangular frames comprising:

a controller means for controlling a cycle of operation;

a framing means for cyclically feeding precut mitered frame members and for forming a rectangular frame therefrom, said framing means being controlled by said controller means and including:

a) a base defining a horizontal plane, b) four respective stands, c) a mounting means for mounting said four stands adjustably to said base such that each of said stands is located at an apex of a preselected size of a rectangle in a plane parallel to the horizontal plane of said base, d) a respective support table integral with each said stand, said support tables providing a plane of support parallel to the horizontal plane of said base, e) a respective magazine means associated with each adjacent pair of said stands for holding precut mitered frame members in a vertical stack above the plane of support, each said magazine means including a width adjusting means for adjusting a horizontal width of the respective said magazine means to selectively accommodate for frame member of different widths, f) a respective feed means for feeding one frame member from each stack of each said respective magazine means simultaneously onto adjacent pairs of said support tables to form a loose frame, each said feed means including a release means for releasing one frame member from the associated stack while holding the remaining frame members in the stack, said release means being adjustable to selectively accommodate for frame member of different heights, g) a respective clamp means for horizontally clamping together adjacent ends of each frame member on each respective said support table simultaneously to form the loose frame members into a tight rectangular frame, each said clamp means including a corner member movable parallel to the horizontal plane along an axis parallel to an axis of a respective joint of the adjacent frame ends, h) a respective press means for vertically pressing said ends of said frame members downwards against the respective said support table simultaneously, each said press means including a press member which engages the ends and a width adjusting means for adjusting a horizontal position of the respective said press member to selectively accommodate for frame member of different widths and hence for joints to be pressed of different lengths, and i) a respective stapling means for upwardly stapling together said ends of said frame members at each said support table simultaneously in an opposite direction to a pressing of respective said press means in order to form a completed frame, each said stapling means including a position adjusting means for repeatedly adjusting a position of the respective said stapling means along the joint to provide a plurality of staples at selective positions along the joint and to accommodate for joints of different lengths; and a moving means controlled by said controller means for moving the completed frame away from said framing means so that another cycle of operation can commence to form another frame.

10. An apparatus for producing frames as claimed in claim 9:

wherein said stands are formed by first and second vertical plates;

wherein respective said support tables are located between associated said first and second plates and include a central aperture;

wherein respective said clamp means further include a respective actuator for moving a respective said corner member, and wherein each associated said corner member and actuator are located between the associated said first and second vertical plates;

wherein respective said press means are located between associated said first and second plates above the associated said support table; and wherein respective said stapling means are located between associated said first and second plates below the associated said central aperture of the associated said support table.

11. An apparatus for producing frames as claimed in claim 10, wherein each said magazine means includes first and second vertical chute members attached to adjacent said vertical plates of adjacent said stands to provide the horizontal width therebetween, said width adjusting means fixing said first chute member vertically to said vertical plate and fixing said second chute member adjustably to said vertical plate.

12. An apparatus for producing frames as claimed in claim 11:

wherein each said release means includes:

a) a bottom supporting device which supports a bottom surface of a lowermost one of the frame member at each said chute member and which is movable to a non-supporting position, and b) a holding device which holds a second lowermost frame member in position at each said chute member when said bottom supporting device is moved to the non-supporting position, so that only the lowermost frame member is released from the stack when said bottom supporting device is moved to the non-supporting position, and wherein said feed means further includes a moving device which moves the lowermost frame member which is released from the stack onto said support table to a position to form the loose frame.

13. An apparatus for producing frames as claimed in claim 11, wherein each said holding device includes an adjusting means for adjusting a holding position thereof to accommodate different heights of frame members.

14. An apparatus for producing frames as claimed in claim 12, wherein said moving means includes:

a) a gripper which grips one side of the completed frame;

b) a transfer mechanism which reciprocally moves said gripper between a grip position where the completed frame is gripped and an ungripped position where the frame is released by said gripper; and c) a conveyor at the ungripped position which transports the completed frame away from said framing means.

15. An apparatus for producing frames as claimed in claim 14, wherein said mounting means includes:

a) an anchor mounted on said base to which a first one of said stands is attached, said anchor defining X and Y axes radiating therefrom;

b) a first bearing plate mounted for movement on said base along the X axis and to which a second one of said stands is attached;

c) a second bearing plate mounted for movement on said base along the Y axis and to which a third one of said stands is attached;

d) a third bearing plate mounted for movement on said base along both the X and Y axes and to which a fourth one of said stands is attached;

e) a first rack and gear mechanism for moving said first and third bearing plates simultaneously along the X axis; and f) a second rack and gear mechanism for moving said second and third bearing plates simultaneously along the Y axis.

* * * * *